US006431616B1

(12) United States Patent
Julian

(10) Patent No.: US 6,431,616 B1
(45) Date of Patent: Aug. 13, 2002

(54) CHILD SAFETY LATCH ASSEMBLY

(76) Inventor: Ian M. Julian, 2111 Chatou Pl., Kennesaw, GA (US) 30152

( * ) Notice: Subject to any disclaimer, the term of this patent is extended or adjusted under 35 U.S.C. 154(b) by 0 days.

(21) Appl. No.: 09/406,265

(22) Filed: Sep. 24, 1999

(51) Int. Cl.[7] ..... E05C 1/12; E05C 17/44; E05C 17/54

(52) U.S. Cl. ..... 292/171; 292/342; 292/343; 292/DIG. 15; 292/292; 292/295; 292/171

(58) Field of Search ..... 292/342, 343, 292/DIG. 15, 292, 295, 171

(56) References Cited

U.S. PATENT DOCUMENTS

| | | | | |
|---|---|---|---|---|
| 818,090 A | | 4/1906 | Hunter et al. | |
| 2,556,612 A | | 6/1951 | Buntin | |
| 2,676,866 A | | 4/1954 | Woodin | |
| 3,199,938 A | | 8/1965 | Vouk | |
| 3,377,116 A | | 4/1968 | Dalbey | |
| 4,139,249 A | | 2/1979 | Hillman | |
| 4,943,124 A | * | 7/1990 | Dietz et al. | 312/222 |
| 5,071,205 A | * | 12/1991 | Dietz et al. | 312/348 |
| 5,280,974 A | * | 1/1994 | Weintroub | 292/164 |
| 5,785,363 A | * | 7/1998 | Stopfer et al. | 292/165 |
| 5,795,044 A | | 8/1998 | Trewhella, Jr. et al. | |
| 5,823,649 A | | 10/1998 | Hinrichs | |

* cited by examiner

*Primary Examiner*—Chuck Y. Mah
*Assistant Examiner*—Matthew E. Rodgers
(74) *Attorney, Agent, or Firm*—Womble Carlyle Sandridge & Rice, PLLC

(57) ABSTRACT

A latch assembly for releasably maintaining the drawer in a closed position with respect a drawer frame includes a latch guide attached to the interior surface of the front panel of the drawer. The latch guide has a guide channel defined therein, a latch member is slidably received. The latch member engages the drawer frame in its locked position and includes a body to which a spring is mounted for biasing the latch member upwardly into engagement with he drawer frame. The latch member has a ramp along which a slide member moves. The slide member is connected to a rod which, in turn, is connected to a drawer knob. When the knob is pulled forwardly, the latch member is moved downwardly against the force of the spring to disengage the latch member from the frame to enable the drawer to be opened.

3 Claims, 8 Drawing Sheets

CHILD SAFETY LATCH ASSEMBLY

FIELD OF THE INVENTION

This invention generally relates to latching or locking devices. More particularly, the present invention primarily relates to safety latching or locking devices for securing cabinets or drawers against access by children.

BACKGROUND OF THE INVENTION

Latching devices are commonly used for securing cabinets, drawers and other closure devices in a closed and locked position. Such latching devices typically have been in the form of keyed locks mounted in the door or face of a drawer and include a locking bolt that is moved into locking engagement with the frame of the door or drawer as they key is turned. Such key locks are, however, not practical or are inconvenient for use with drawers or cabinets that are frequently accessed, such as kitchen cabinets, such that it is impractical to have to replace/use a key to pen the drawer or cabinet. However, it is also often necessary for these cabinets to be secured against access by small children to prevent them from reaching dangerous or breakable objects such as knives or glassware.

Accordingly, childproof latching or locking devices have been developed to secure drawers and cabinet doors. For example, U.S. Pat. Nos. 4,139,249 and 5,823,649 disclose child-proof latches for cabinets and drawers. The problem with such child-proof latching devices, however, typically has been that they are difficult to operate, as they generally include a spring biased catch or lock located inside the drawer or cabinet. Thus, the person opening the drawer or cabinet generally must hold the door or drawer open with one hand while reaching into the drawer and depressing the catch with the other hand.

SUMMARY OF THE INVENTION

Briefly described, the present invention relates to a safety latch for drawers, cabinets or similar closure devices. One embodiment of the invention contemplates a child safety latch assembly for a drawer, which typically includes a bottom panel, side panels, and a front panel with interior and exterior faces or surfaces. Each drawer is received and supported on a drawer frame typically mounted in a cabinet or chest of drawers, and on which the drawer slides or moves between an open and a closed position. The latch assembly is generally attached to the interior surface of the drawer front panel and releasibly engages the drawer frame to prevent unauthorized access into the drawer.

The latch assembly comprises a latch guide attached to the interior surface of the front panel of the drawer and having a guide slot or channel, and a latch member slidably received in the guide channel. The latch member includes a body having a forward engaging portion that contacts the drawer frame when the drawer is in its closed position with the latch assembly in a locked, engaging position, and a rearwardly extending projection or base. The base is attached to the forward engaging portion, and includes a ramp portion that slopes upwardly toward the forward engaging portion. The ramp portion of the base has a flat upper surface and includes a slot formed approximately centrally therein. A biasing element such as a spring is mounted to the bottom of the latch member and bears against the bottom panel of the drawer to cause the latch member to be urged upwardly into its locked position in engagement with the drawer frame.

A bore is formed through the latch guide and the drawer front panel, and is aligned with the slot formed in the latch member. A connector member, such as a threaded rod or bolt is extended through the bore, extending through both the drawer front panel and the latch guide, and attaches at one end to a conventional drawer knob on the exterior surface or face of the front panel of the drawer. A slide member is slidably disposed along the upper surface of the ramp of the latch member, and is connected to the opposite end of the rod from the drawer knob.

As the face of the drawer is held stationary, the knob is pulled forwardly, the slide member is pulled forwardly and slides along the upper surface of the ramp portion, causing the latch member to be urged downwardly against the spring. The By latch member is thus moved out of engagement with the drawer or cabinet frame to place the latch member in an unlocked position to enable the drawer or cabinet door to be moved to an opened position.

Various objects, features, and advantages of the present invention will become apparent to those skilled in the art upon reading the following specification, when taken in conjunction with the accompanying drawings.

DETAILED DESCRIPTION OF THE INVENTION

Figure 1:
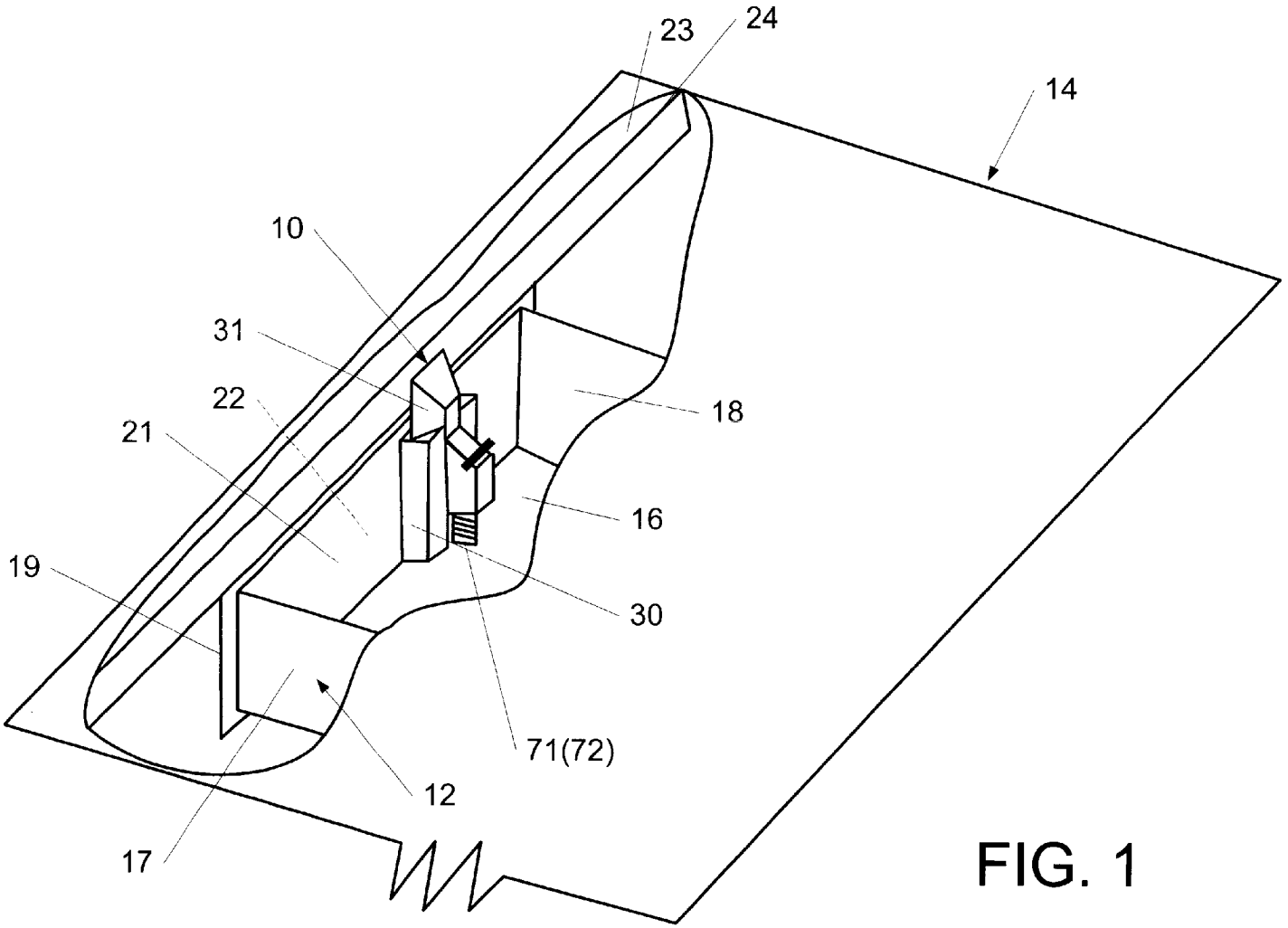
FIG. 1 is perspective view of a latch assembly constructed in accordance with the present invention.
Figure 2:
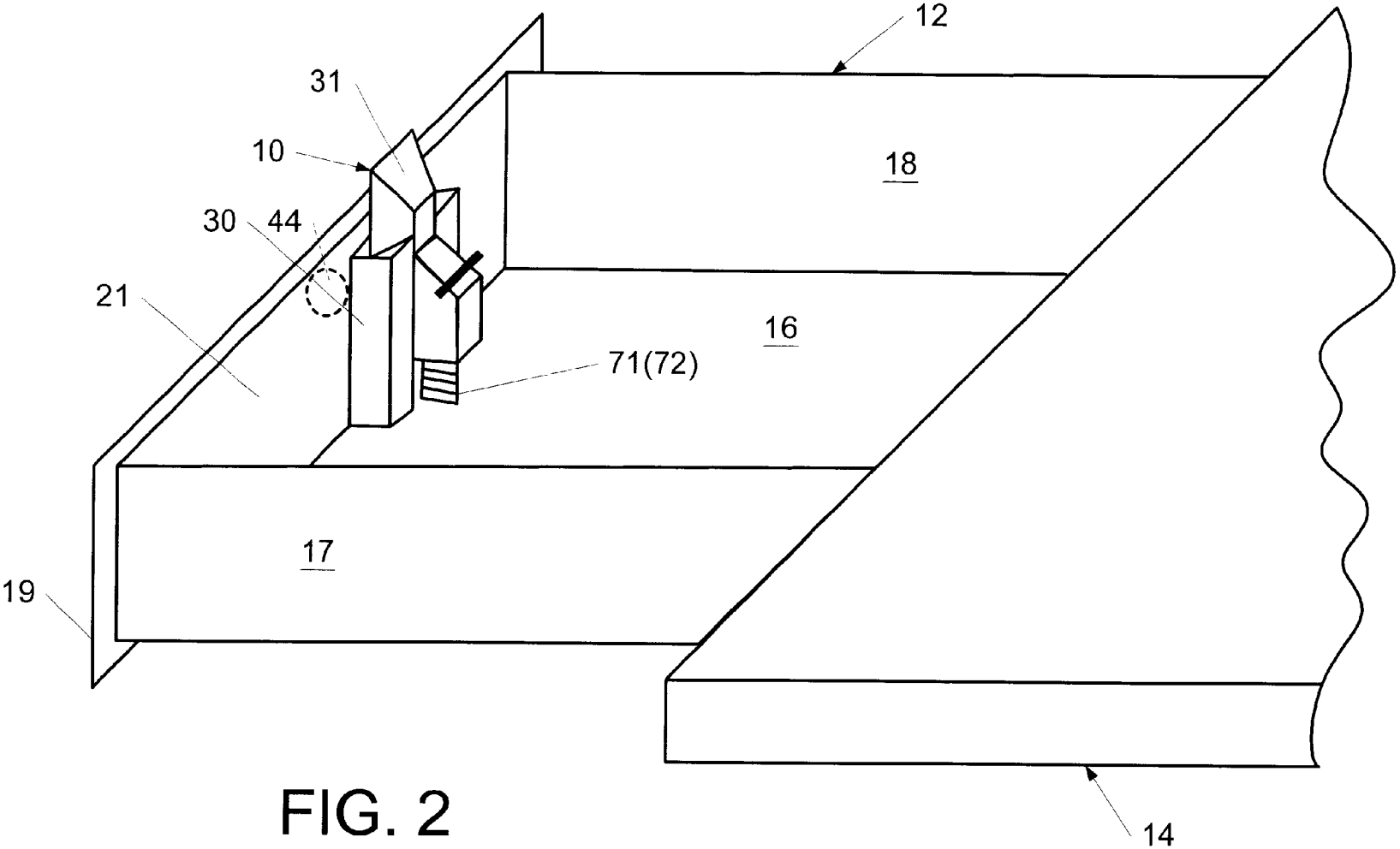
FIG. 2 is a perspective view of the latch assembly for a drawer shown in FIG. 1, with the drawer shown in an opened position.

Referring now in greater detail, to the drawings in which like numerals indicate like parts throughout the several views, FIGS. 1 and 2 illustrate a latch assembly 10 disposed within a closure member such as a drawer 12 carried by a drawer frame 14 such as for a chest of drawers. The drawer 12 and frame 14 are shown merely to define an example environment in which the latch assembly 10 can operate, and it will be understood by those skilled in the art that other types of closure members other than drawers, such as cabinets, closet doors, or similar assemblies also can be secured using the latch assembly of the present invention.

As shown in FIGS. 1 and 2, the drawer 12 generally includes a bottom panel 16, side panels or walls 17 and 18 and a front panel 19 having exterior and interior facing surfaces 21 and 22. Similarly, the drawer frame 14 includes a series of frame pieces or sections 23 (FIG. 1), each having an interior facing surface 24, with a drawer opening 26 defined in the frame. The drawer 12 is received and slides into and out of the drawer opening 26 as it is moved between a closed position shown in FIG. 1 and an open position shown in FIG. 2.

Figure 4:
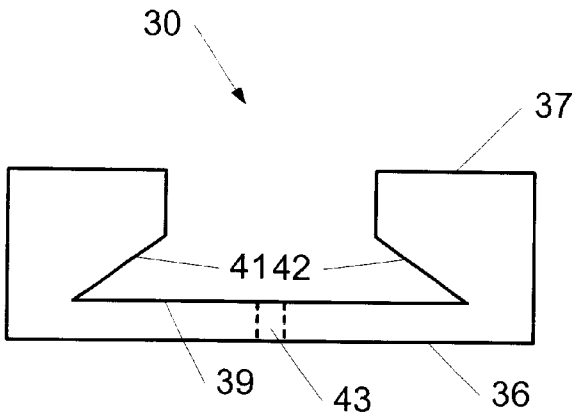
FIG. 4 is an end view of the latch guide illustrated in FIG. 3.

The latch assembly 10 includes a latch guide 30 which supports and guides a latch member 31 as the latch member is moved between an engaging locked position shown in FIG. 1 and a nonengaging, unlocked position shown in FIG. 2. The latch guide is illustrated in greater detail in FIGS. 3 and 4, and generally includes a substantially rectangularly shaped body 32 typically formed from a plastic, generally a low friction plastic material such as ABS, nylon or Delrin, although it will be understood that it will also be possible to form the latch guide from wood, metal or other durable, high strength materials. The body 32 of the latch guide 30 typically is approximately 3 to 5 inches high by approximately 1 to 2 inches in width and approximately ½ to 1 inch in thickness. The body also includes an upper end 33 typically spaced below the upper end of the front panel 19 (FIG. 1) of the drawer 12, a bottom or lower end 34 that typically rests upon the bottom panel 16 of the drawer, a front face or surface 36 that is applied against the interior surface 22 of the front panel 19, and a rear surface 37 in which a guide slot or channel 38 is formed. It is also possible to apply a bearing plate to the bottom of the latch guide to serve as a stop for the latch member as it is moved through the latch guide for use of the latch assembly 10 on cabinet or closet doors or in applications where the bottom 34 of the latch guide is spaced above the bottom panel of the drawer or a cabinet.

Figure 3:
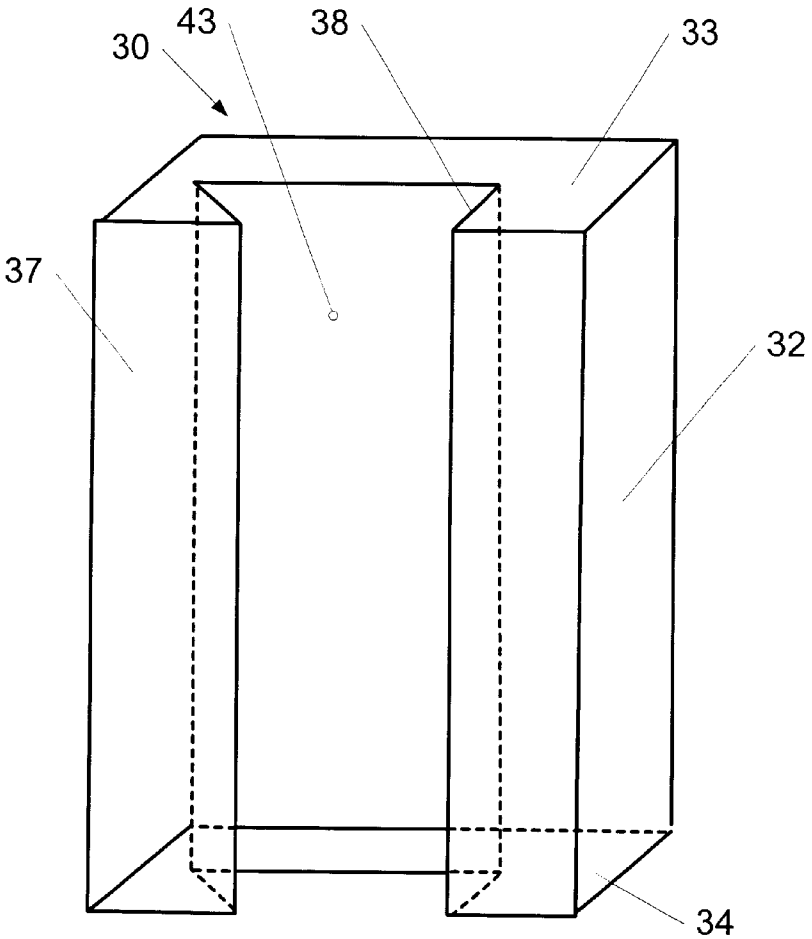
FIG. 3 is a perspective view of the latch guide.

As illustrated in FIG. 3, the guide channel 38 is formed in the rear surface 37 of the body 32, defined by a rear face 39 spaced inwardly approximately ½ to ¾ inch from the rear surface 37, and a pair of angled side walls 41 and 42 that extend inwardly at an angle of less than 90°. Typically, the side walls are oriented at a 45° angle for ease of manufacture. The guide channel extends the length of the latch body and thus provides a series of guiding or bearing surfaces against which the latch member 31 is received and slides.

In addition, a bore 43 is formed through the body 32 of the latch guide 30, extending from the rear face 39 of the guide channel through the body 32 to the front face 36 of the body. The bore typically is aligned with a corresponding bore (not shown) formed through the front panel of the drawer, that typically is used for securing a handle or knob 44 (shown in dashed lines in FIG. 2) to the front panel.

As illustrated in FIGS. 2 and 5–8, the latch member 31 generally includes a body 50 formed from a low friction plastic material such as ABS, nylon or Delrin, typically the same material as used to form the latch guide, although it will be understood that other types of materials such as wood or metals also can be used. The body 50 of the latch member 31 generally includes a forward, engaging portion 51 and a rearwardly extending projection or base 52.

Figure 8:
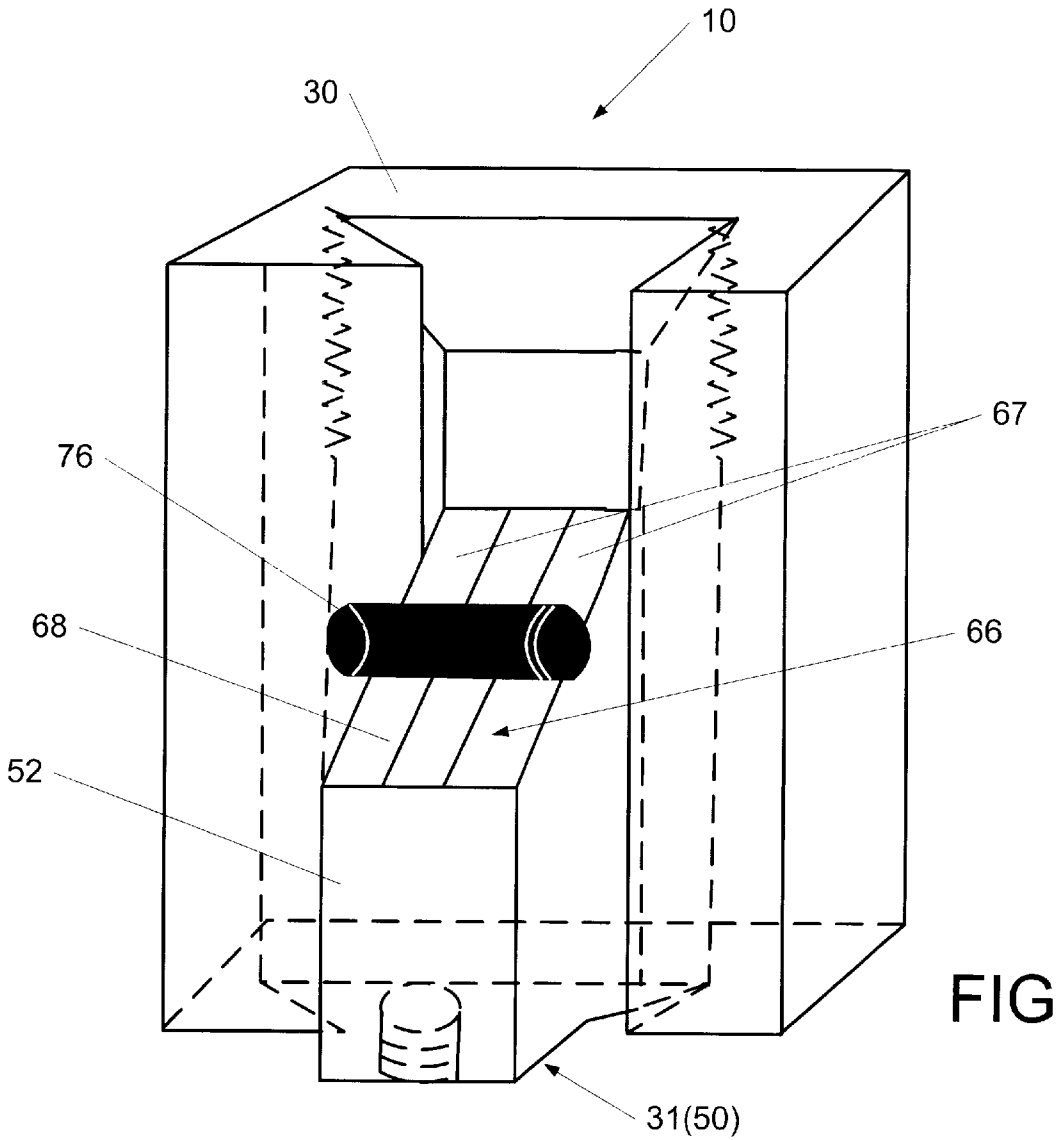
FIG. 8 is a perspective view of the latch member slidably received within the latch guide, together with the slide member, and with the latch member in its lowered position.
Figure 10:
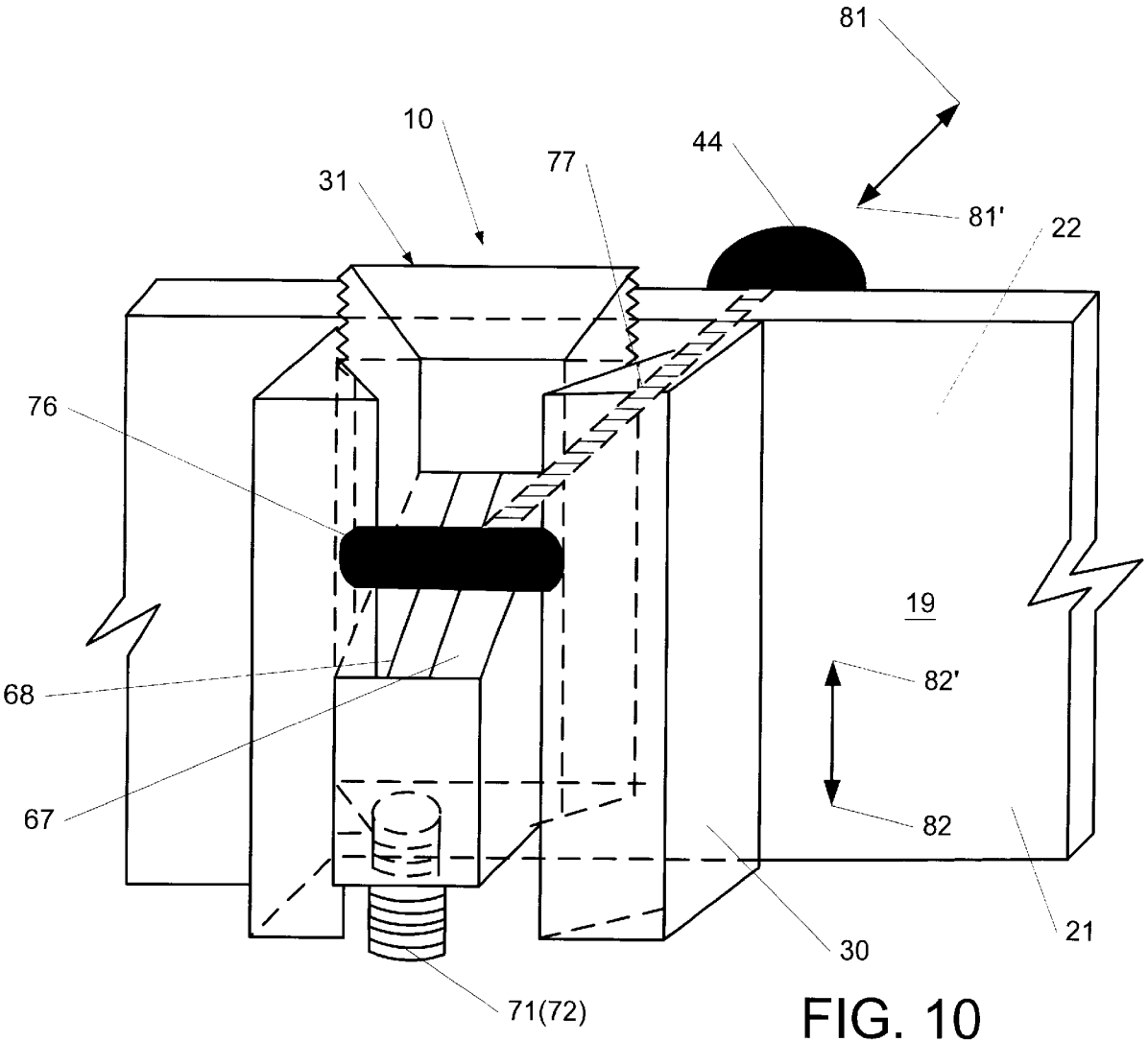
FIG. 10 is a perspective view of the latch assembly illustrating the rod connecting the slide member to a drawer knob.

The engaging portion 51 is substantially rectangularly shaped and includes a flat front face 53 that is adapted to engage and slide along the rear face 39 (FIG. 4) of the latch guide 30, a substantially flat bottom surface 54, a rearwardly and downwardly sloping top surface 56, and inwardly sloping side walls 57 and 58 that are formed at an angle approximately corresponding to the angle of the side walls 41 and 42 (FIG. 4) of the latch guide. As shown in FIGS. 8 and 10, the front face and side walls of the body 50 engage and slide along, and thus are guided by the rear face and side walls of the guide channel 38 of the latch guide for moving the latch member between its locked and unlocked positions.

In addition, a series of serrations or teeth 59 (FIG. 5) are formed adjacent the upper end of the front face 53 of the body 50. These serrations or teeth tend to engage and bear against the interior facing surface 24 (FIG. 1) of the frame sections 23 of the drawer frame 14 to help maintain the latch member in engagement with the drawer frame when in its raised, engaging, locked position as shown in FIG. 1.

Figure 5:
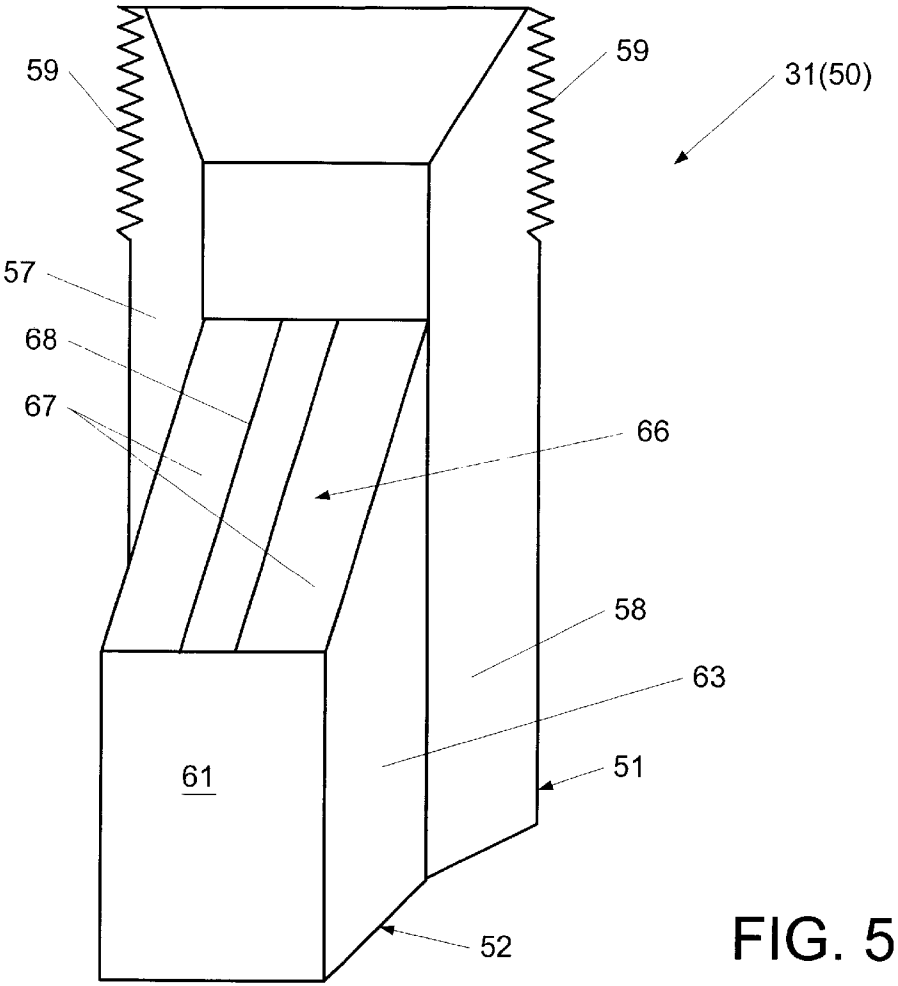
FIG. 5 is a perspective view of the latch member of the latch assembly illustrated in FIGS. 1 and 2.
Figure 6:
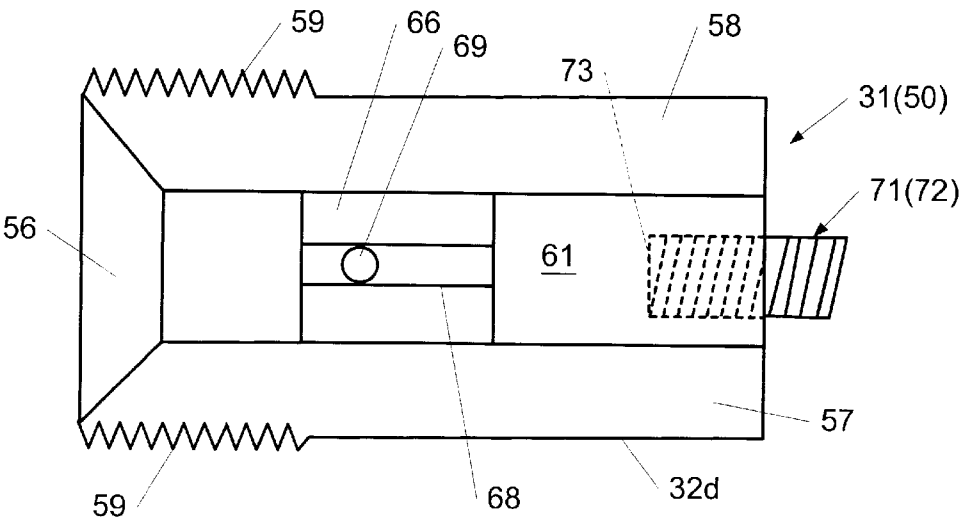
FIG. 6 is a plan view of the latch member of FIG. 5.
Figure 7:
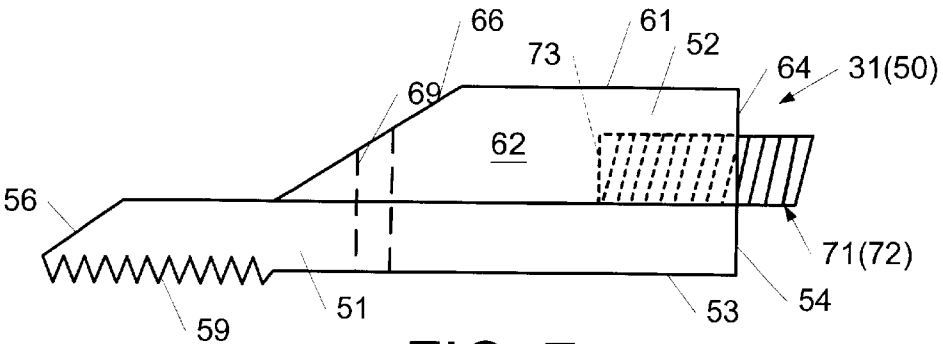
FIG. 7 is a side elevational view of the latch member of FIG. 5.

As shown in FIGS. 5–7, the base portion 52 of the body 50 of the latch member 32 generally is substantially rectangular, having substantially flat rear, side and bottom surfaces 61–64, respectively. The upper or top surface of the base is typically formed as a ramp 66 that slopes downwardly from the engaging portion 51 toward the rear surface 61 of the base 52. The ramp portion 66 typically includes upper surfaces 67 that are spaced apart to define a slot or channel 68 that extends through the base to the forward, engaging portion of the latch member. As shown in FIGS. 6 and 7, a slotted opening 69 is formed through the forward engaging portion of the body 50, opening into the slot 68 and generally aligned with the bore formed through the latch guide.

As shown in FIGS. 6–8 and 10, a biasing element 71 generally is mounted to the bottom surface 64 of the base 52. Typically, the biasing element is a compression spring 72, although other types of resilient members also can be used. The biasing element applies a biasing force to the latch member to bias the latch member to its raised, engaging and locked position shown in FIG. 1. An open ended channel or recess 73 (FIGS. 6 and 7) generally is formed in the base, as indicated in the dashed lines in FIGS. 6 and 7 and receives the biasing element, such as spring 72, therein and provides a bearing surface against which the spring is compressed and bears against to urge the latch member upwardly.

Figure 9:
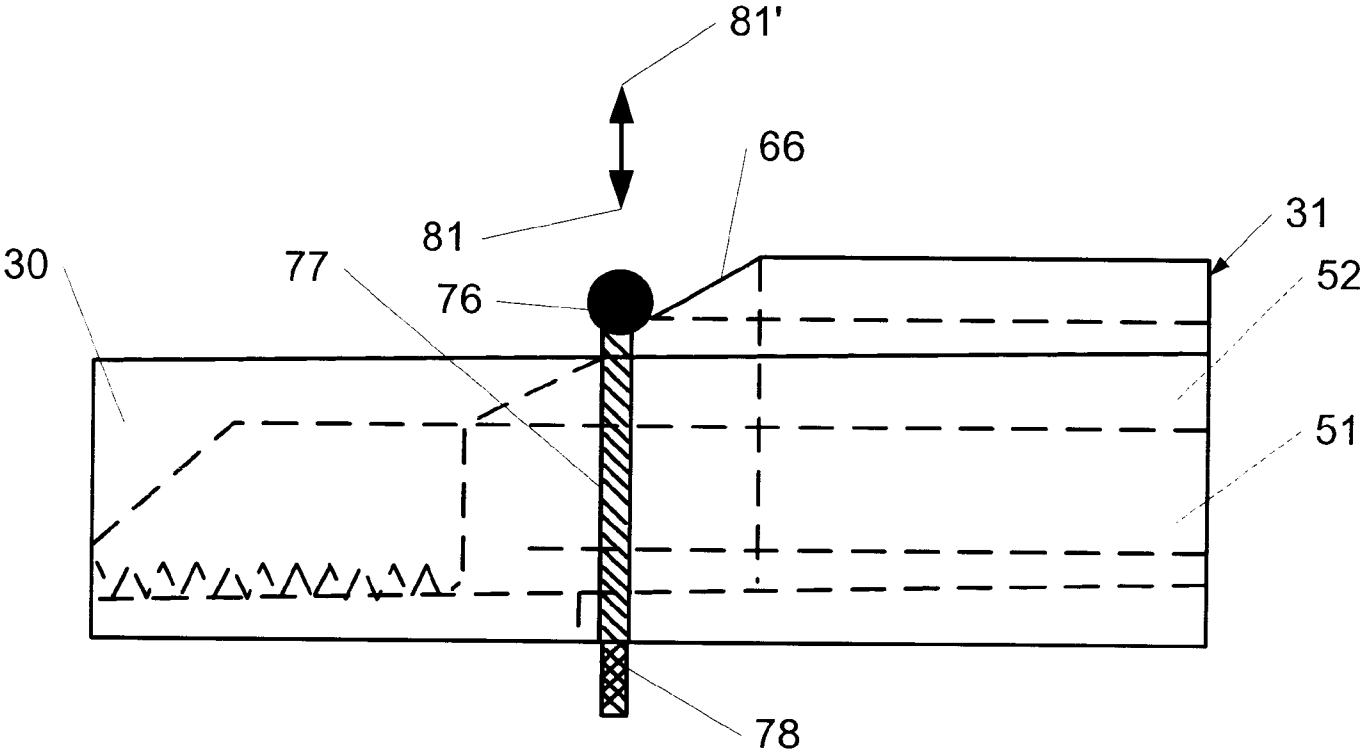
FIG. 9 is a side elevational view of the latch assembly.

As illustrated in FIGS. 8–10, a slide member 76 is received and slides along the sloping upper surfaces 67 of the ramp 66 of the latch member. The slide typically is formed from a plastic, metal or similar durable, low friction material, and typically is formed as a cylinder or block having an angled surface (not shown). The slide member engages and slides along the upwardly sloping upper surfaces of the ramp as the latch member is moved through the latch guide. A connector member 77 is received through the slot 68, slotted opening 69 and bore 43 of the latch member and latch guide and through the front panel of the drawer, as indicated in FIG. 10. The connector member 77 generally is a threaded rod or bolt that connects at a first end 78 to drawer knob 44, and at a second or opposite end 79 to the slide member 76. Thus, as the drawer knob 44 is pulled forwardly, away from the drawer in the direction of arrow 81, the slide member likewise is pulled forwardly. This in turn causes the latch member to be urged downwardly as a slide member is pulled along the upper surfaces of the ramp 66, overcoming the force of the biasing element, so as to cause the latch member to be moved to its lowered, nonengaging, unlocked position shown in FIG. 2.

In addition, for drawers or cabinets having handles or "pulls", which are connected to the door via a pair of screws, a pair of latch assemblies can be positioned within the drawer or cabinet or the latch assembly can be of an expanded width so as to provide for pairs of slots 68 and bores 43 (FIG. 3) to enable the use of a pair of connecting rods in place of the screws for the handle or pull.

In use of the latch assembly 10, as illustrated in FIG. 10, the latch assembly typically is installed in a conventional drawer or cabinet by simply removing the existing knob or handle and replacing the existing screw for holding the knob against the front panel of the drawer cabinet with the connector member 77. The connector member is inserted through the bore formed in the front panel of the drawer into which the knob is reattached as illustrated in FIG. 10. Thus, no additional mounting hardware is needed and the appearance or configuration of the drawer/cabinet does not have to be altered to install the latch assembly. The latch guide is placed inside the cabinet or drawer and generally with its bottom surface resting on the bottom panel of the drawer as indicated in FIGS. 1 and 2, although in use with a cabinet, an additional fastening means such as adhesive can be applied to the front face 36 of the latch guide 30 to help secure it against the interior surface 22 of the panel 19. The engagement of the spring or biasing element 71 against the bottom panel of the drawer or cabinet or against a bearing plate for the latch guide tends to urge the latch member 31 upwardly in the direction of arrows 82 (FIGS. 1 and 10) so that the latch member is naturally biased into its raised, engaging and locked position wherein the serrations or teeth 59 (FIG. 10) formed in the front face 53 of the forward engaging portion of the latch member can engage and bear against the interior facing surface 24 (FIG. 1) of the frame sections 23 of the drawer frame 14. In addition, the length of the biasing element, such as spring 72, can be adjusted to compensate for variations in the distance between the bottom surface of the latch guide with respect to the bottom panel of the drawer or cabinet to compensate for any differences or spacing between the bottom surface of the latch guide and the bottom panel of the drawer/cabinet.

Once the latch assembly has been secured within the drawer or cabinet, in use, as the drawer or cabinet door is closed, the engagement of a frame section 23 against the sloped top surface 56 of the forward engaging portion 51 of the latch member 31 tends to urge the latch member downwardly, overcoming the force of the biasing element 71 to enable the latch member to pass beneath the frame section and enable the drawer or cabinet door to be closed. Thereafter, the compression force of the biasing element 71 tends to bias the latch member upwardly in the direction of arrow 82' (FIGS. 1 and 10) so as to move the latch member to its raised, engaging and locked position in engagement with the interior surface of the frame section. Thus, the drawer is prevented from opening until sufficient force is applied to the latch member to overcome the force of the biasing element 71 and cause the latch member to be moved downwardly to its lowered, nonengaging and unlocked position shown in FIG. 2.

To open the drawer or cabinet door, the user holds the exterior facing surface of the front panel of the drawer and pulls the knob 44 outwardly in the direction of arrow 81 (FIG. 10). As the knob is pulled outwardly, the slide member 76 is pulled forwardly, and bears against the sloped upper surfaces of the ramp 66. The latch member is consequently urged downwardly, overcoming the force of the spring so as to move the latch member to its lowered, nonengaging and unlocked position to enable the drawer to be opened as shown in FIG. 2. If the knob is pulled without the front panel of the drawer being held stationary, the latch member generally is held against the inside of the cabinet or drawer frame by the frictional engagement of the serrations formed in the latch member bearing against the frame. Thus, the drawer is prevented from being opened simply by pulling on the knob alone.

The present system thus provides a mechanism for existing or preventing unauthorized access to drawers and cabinets more primarily by children. The present system further is easily installed in existing drawers or cabinets without requiring additional hardware to be installed to the face of the drawer or cabinet door, but instead uses the existing knob or handle pull for the drawer or cabinet door to avoid disturbing or otherwise altering the outside appearance of the drawer or cabinet door.

While a preferred embodiment of the invention has been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include any structure, material, or acts for performing the functions in combination with other claimed elements as specifically claimed herein.

I claim:

1. A latch assembly for restricting access to a drawer having a bottom panel and a front panel with interior and exterior surfaces, said latch assembly comprising:

a latch guide attached to the front panel of the drawer and having a guide channel defined therein;

a latch member slidably received in said guide channel of said latch guide, and said latch member including a body having an engaging portion that contacts a frame in which the drawer is received when the drawer is closed and said latch is in its engaging, locked position;

a base attached to said engaging portion of said body and having a ramp portion that extends upwardly toward said engaging portion;

a biasing element mounted to said latch member for urging said latch member toward a locked position to secure the drawer in a closed position; and a connector extending between said latch member and a knob positioned adjacent the exterior surface of the front panel of the drawer;

a slide member slidably disposed along said ramp portion; and a bore extending through said latch guide, said latch member, and through the front panel of the drawer;

wherein said connector is attached at one end to said slide member and attached at another end to the drawer knob;

whereby as said knob is moved away from the exterior surface of the front panel said latch member is urged along said latch guide toward an unlocked position to enable the drawer to be moved to an open position.

2. A latch assembly for restricting access to a drawer having a bottom panel and a front panel with interior and exterior surfaces, said latch assembly comprising:

a latch guide attached to the front panel of the drawer and having a guide channel defined therein;

a latch member slidably received in said guide channel of said latch guide, and said latch member including a body having an engaging portion that contacts a frame in which the drawer is received when the drawer is closed and said latch is in its engaging, locked position; and a base attached to said engaging portion of said body and having a ramp portion that extends upwardly toward said engaging portion;

a biasing element mounted to said latch member for urging said latch member toward a locked position to secure the drawer in a closed position; and a connector extending between said latch member and a knob positioned adjacent the exterior surface of the front panel of the drawer;

said engaging portion includes a forward side surface having a series of serrations formed therein for engaging the drawer frame;

whereby as said knob is moved away from the exterior surface of the front panel said latch member is urged along said latch guide toward an unlocked position to enable the drawer to be moved to an open position.

3. A latch assembly for restricting access to a drawer having a front panel wherein said latch member comprises:

a body having an engaging portion that contacts a frame in which the drawer is received when the drawer is closed and said latch is in its engaging, locked position;

a base attached to said engaging portion of said body and having a ramp portion that extends upwardly toward said engaging portion;

a slide member slidably disposed along said ramp portion;

a latch guide attached to the front panel of the drawer and having a guide channel defined therein; and a bore extending through said latch guide said latch member and through the front panel of the drawer.

* * * * *